US005509368A

United States Patent [19]

Wald

[11] Patent Number: 5,509,368

[45] Date of Patent: Apr. 23, 1996

[54] SAILBOAT WITH PIVOTABLE MAST

[76] Inventor: Walter S. Wald, 1500 Belmont Ave., Mulberry, Fla. 33860

[21] Appl. No.: 394,778

[22] Filed: Feb. 27, 1995

[51] Int. Cl.[6] ..... B63B 35/00

[52] U.S. Cl. ..... 114/39.1; 114/91

[58] Field of Search ..... 114/39.1, 39.2, 114/89, 90, 91, 92, 93, 102, 103

[56] References Cited

U.S. PATENT DOCUMENTS

| | | | |
|---|---|---|---|
| 241,037 | 5/1881 | Lyman | 114/91 |
| 273,529 | 3/1883 | Hicks | 114/91 |
| 641,321 | 1/1900 | Perkins | 114/91 |
| 3,885,512 | 5/1975 | Marcil | 114/91 |
| 3,972,300 | 8/1976 | Adamski | 114/39.1 |
| 3,985,106 | 10/1976 | Ross | 114/91 |
| 4,005,669 | 2/1977 | Klemm | 114/91 |
| 4,259,917 | 4/1981 | Frank | 114/91 |
| 4,706,590 | 11/1987 | Hoyt | 114/91 |
| 5,280,760 | 1/1994 | Edwards | 114/39.1 |

*Primary Examiner*—Stephen Avila
*Attorney, Agent, or Firm*—Dominik & Stein

[57] ABSTRACT

A sailboat having improved comfort and safety and comprising a hull having a deck having a port side, a starboard side, and a central portion between the port and starboard sides; at least one mast extending above the deck, the mast being pivotably attached to the hull about a fore-and-aft running axis; and means for controllably pivoting the mast in the port-to-starboard direction. This sailboat makes it possible to maintain the hull of the sailboat in as near a horizontal position as desired for comfort and safety. The system may be controlled manually or automatically. Existing sailboats can be readily retrofitted according to the present invention.

2 Claims, 2 Drawing Sheets

SAILBOAT WITH PIVOTABLE MAST

BACKGROUND OF THE INVENTION

1. Field of the Invention

The present invention concerns a system and device for rendering a sailboat comfortable and safe from danger of capsizing, and more specifically relates to a sailboat with a mast which can be either automatically or manually pivoted to port or starboard.

2. Description of the Related Art

A sailboat is basically comprised of a hull having bottom, bow and stern portions, a deck, and at least one mast for supporting a sail extending above the deck. The mast is traditionally rigidly set so as to remain in the same relative position with respect to the hull. A fixed keel extends from the bottom, and a ballast is rigidly formed to the keel to aid in stabilizing the hull. The keel is heavily weighted to provide a substantial amount of ballast to add stability to the sailboat when under way. Wind acts upon the sail and the sail bears upon the mast, occasioning the forward travel of the sailboat, and also incidentally deflecting the mast to the leeward side so that the leeward edge of the sailboat is depressed towards the water level. As the sailboat heels further, asymmetrical underwater hull shape tends to cause veering of the craft off-course while increasing the bow wake and resistance to forward movement.

The traditional fixed mast arrangement is generally regarded as providing a measure of safety and security. That is, it is perceived that as the sailboat keels over, fixed ballast down low will reliably lever the boat back towards vertical. However, if the force of the wind acting upon the sail is too strong, even a heavy ballast will not prevent the sailboat capsizing.

The three primary factors effecting a sailboat are buoyancy, gravity, and wind. Buoyancy can be modified to improve stability by modifying the shape of the hull, i.e., by increasing displacement to port and starboard as in the case of a catamaran. However, such an approach reduces the habitable space of the sailboat, thus is not a practical approach.

Attempts have also been made to improve sailboat stability and safety by addressing ballast. Sailboat crews have long been employed as movable ballast, moving to windward as the sailboat heels thereby to prevent the hull from capsizing and to maintain the stability of the hull. However, as the hull heels further and further over, the crew weight is moved closer to being over the center of buoyancy of the sailboat, the effect of the righting arm decreases, their effectiveness as ballast is lowered, and the further the boat heels, the less stable the boat becomes, until it ultimately capsizes.

Proposals have been made to use an articulating keel with ballast mounted at the bottom of the keel. In theory, ballast provided at the bottom of an articulating keel can be moved as needed to port or starboard so that the center of gravity of the sailboat is moved further windward of the center of buoyancy, increasing the righting arm. For purposes of speed, it makes sense to move the keel weight sideways, saving weight while keeping hull, rig and underwater foils in their most effective vertical mode. However, such a system adds significantly to the cost of a sailboat and to the complexity of sailing. Tilting the keel centerboard off-vertical decreases the plane of the centerboard against the water, increasing the sideways-to-forward movement ratio of the sailboat. Further, as the sailboat heels over to near the point of capsize, the movable keel can do nothing to help right the sailboat, since in that orientation of the hull the movable keel substantially corresponds to the position of a fixed keel/fixed ballast sailboat. That is, with a traditional sailboat, the greater the heel, the greater the effect of the ballast. Further yet, a movable keel is not visible, and a keel tilted in the wrong direction, particularly in a situation such as an emergency change of tack, will readily result in capsizing.

U.S. Pat. No. 3,972,300, shows a sailing craft having a one-piece hull design with a unitary mast, keel, and ballast assembly mounted on the hull of the craft so that the mast, keel, and ballast assembly can rotate independently on the hull to permit the hull of the craft to float free of the wind heeling forces. In U.S. Pat. No. 3,885,512, a catamaran structure is shown in which the mast and sail are also formed as a unitary structure to tilt laterally to port or starboard when the catamaran is underway. The unitary structure of the mast and the keel are rotatably mounted to the platform above the water level in the catamaran.

U.S. Pat. No. 5,280,760 teaches a sailing craft in which a mast is rigidly connected to a keel via a transfer shaft having a pivot axis along the bottom of the hull of the sailboat, and in which the rigid mast and keel assembly is mounted for side-to-side movement relative to the hull. Ballast is provided at the bottom of the keel. Movement of the mast from side-to-side rotates the keel in the opposite direction from the mast to stabilize the sailboat. There is an increase in safety, since any increase in wind on the sail causes the sail to tilt without heeling the sailboat hull. However, on closer analysis, it can be seen that the gain in stability from pivoting the keel and mast is at great cost. First, the righting moment due to the change in center of buoyancy which occurs with heeling of a conventional fixed-mast sailboat is lost, since the hull effect is not transmitted to the mast. Second, since the effect of wind on the sail must be counteracted by an opposite action of the ballast of the keel, and since the vertical keel is at equilibrium and imparts no righting moment, this sailboat can not be sailed with the mast vertical. Rather, the mast will always tilt until equilibrium is reached between, on the one hand, the force of wind urging the sail to leeward, and on the other hand, the force of gravity tending to cause the offset ballast of the keel to return to vertical. Thus, this system is far from optimal.

U.S. Pat. No. 3,885,512 is similar in principle to U.S. Pat. No. 5,280,760, except that the principle is applied to a catamaran structure.

The third approach, after buoyancy and ballast, has been with respect to movement of the sails. U.S. Pat. No. 241,037 teaches a sailboat rendered more capsize proof by providing a pivotably mounted mast kept perpendicular to the hull by means of springs. The force of wind acting upon the sails causes the springs to give and the mast to be tipped transversely to port or starboard. While this may appear to improve safety in the case of a sudden gust of wind, on closer examination it can be seen that this system has a number of disadvantages, including the fact that the mast is most caused to pivot when least needed, i.e., when the sailboat is vertical and the force of wind on the sail is strong. The mast is least likely to give and pivot when most needed, i.e., in the final arc of heel in which the sailboat is nearest capsizing. In fact, the system is actually dangerous, in that as the sailboat heels over, the force of the wind on the sail is reduced, and as the sailboat comes close to capsizing, the springs urge the mast to a more upright position to catch more wind, thus increasing the tendency to capsize at precisely the time when what is needed is a lessening of wind force on the sails.

U.S. Pat. No. 273,529 teaches a mast and spar arrangement wherein the sail is permitted to set off from the mast to leeward, better enabling the boat to tip up to the wind. As the boat keels to leeward, the offset sail is more upright than the mast, and gets more benefit from the wind. However, while increasing the speed and ability to capture wind, the arrangement does not improve safety. In fact, the arrangement causes the sail to receive more wind as the sailboat careens or heels, increasing the likelihood of capsizing.

U.S. Pat. No. 641,321 teaches a sailboat in which a mast is mounted so as to remain perpendicular to the hull, yet so mounted so as to be capable of being relocated either port or starboard of the centerline of the sailboat. This has a beneficial effect with regard to the relationship of the wind force vector and the weight of the mast and sails to the center Of gravity of the sailboat and the center of buoyancy of the sailboat. However, there is no improvement with respect to safety, as this sailboat, once heeled, is as likely to capsize as a conventional sailboat.

U.S. Pat. No. 4,005,669 teaches a mast displacement mechanism comprising a cradle supported by the hull and defining a track structure. The upper end of the mast is connected via cables to port and starboard points on the deck, such that the mast can pivot about a pivot axis defined by the attachment points of the cables to the mast. The cradle is of radius and curvature that the lower end of the mast rests in and is free to move to port and to starboard on the track of the cradle. The pivot for the tilt of the mast is located at the upper zone of the mast, as a pendulum, and the lower deck end of the mast is capable of moving through and arc, guided by the track means along a radius of curvature between the pivot and track means. This mast displacement mechanism permits the sailboat to point closer to the wind, to better utilize hull forms, and to minimize list under varying wind conditions. However, the range of adjustment of the sail is necessarily constrained by the length of track confined by the hull.

While the above mentioned patents are representative of the designs which have been developed to provide sailboats of improved stability and safety, each of the known approaches has significant disadvantages which offset the purported advantages. Further, the above described systems and devices are generally too mechanically complex for retrofitting of existing sailboats.

There remains a need for a sailboat mast adjustment system and means which is easy to understand and use, inexpensive, and capable of being retrofitted on existing sailboats.

SUMMARY OF THE INVENTION

It is, accordingly, an object of this invention to provide a mast displacement mechanism which is intuitive to understand, easy to use, and which increases the safety and stability of the sailboat.

It is also an object to provide a sailboat which is provided with a mast displacement mechanism which is safe due to controllable relationship of the mast and sail to the hull, such that there is no danger of capsizing even in the strongest wind that will normally be encountered.

It is yet a further object of the invention to provide a system and device with which existing sailboats can be readily and economically retrofitted.

Yet another object of the invention is to provide a sailboat in which the enjoyment thereof is enhanced by the user.

These and other objects are accomplished by means of a sailboat comprising a hull having a deck having a port side, a starboard side, and a central portion between said port and starboard sides; at least one mast extending above the deck, the mast being pivotably attached to the hull about a fore-and-aft running axis; and means for controllably pivoting the mast in the port-to-starboard direction.

In a preferred embodiment of the invention, port and starboard cables are attached to the mast, port cables are controlled by means of at least one port winch, and starboard cables are controlled by at least one starboard winch. The winches are provided with adjustable slippage clutches, and are controlled electronically by means of a control unit. The control unit is provided with input regarding the true horizon, input regarding the orientation of the mast relative to the deck, and input regarding the tension on the port and starboard cables, such that port and starboard cables are maintained within a minimum and a maximum tension. The minimum and said maximum tensions are values which are preset into said controller, such that when the mast is perpendicular to the deck and said deck is horizontal, tension on the windward winch is high since there is little chance of capsizing; when the mast is perpendicular to the deck and the deck is off-horizontal, the tension on the windward winch is lowered, and the tension on the leeward winch is increased until the deck reaches a preset horizontal value; and when the mast is pivoted to leeward and said deck is horizontal, tension on the windward winch is increased and tension on the leeward winch is decreased to cause the mast to be pivoted to a position perpendicular to the deck.

The foregoing has outlined rather broadly the more pertinent and important features of the present invention in order that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other pivotable masts for carrying out the same purposes of the present invention. It should also be realized by those skilled in the art that such equivalent structures do not depart from the spirit and scope of the invention as set forth in the appended claims.

BRIEF DESCRIPTION OF THE DRAWING

For a fuller understanding of the nature and objects of the present invention reference should be made the following detailed description taken in with the accompanying drawings in which.

DETAILED DESCRIPTION OF THE INVENTION

Figure 1:
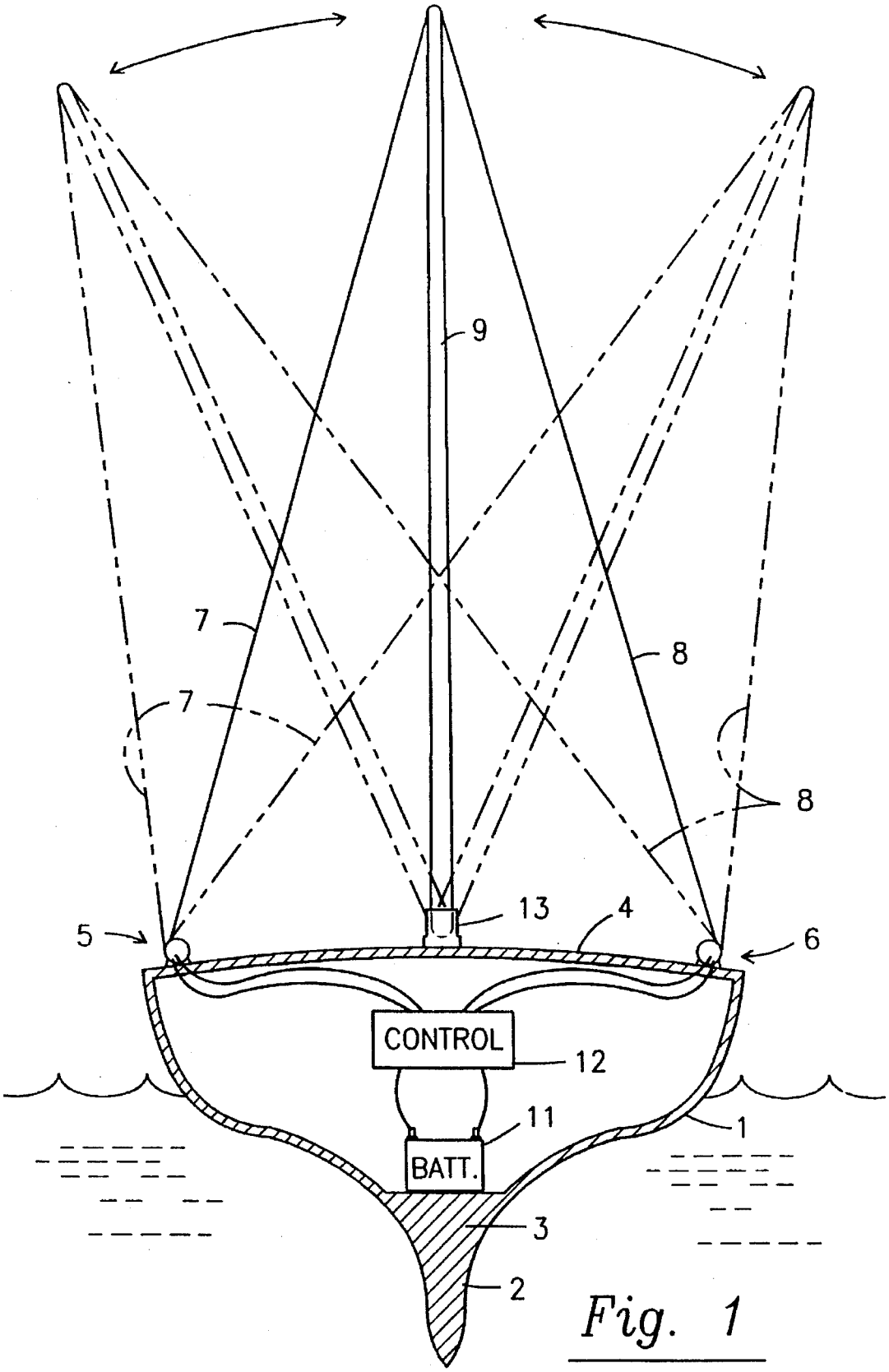
FIG. 1 is a port-to-starboard cross-sectional view of a sailboat according to the invention, showing a mast set to vertical in solid lines, and showing the same mast pivoted to port or starboard in broken lines.

The present invention was made based upon a recognizing of the interrelation of the factors acting upon a sailboat, taking into consideration primarily the forces of gravity, buoyancy, and wind.

The force of gravity can be thought of as the composite force which acts vertically downward through the sailboat's center of gravity. The force of buoyancy can be thought of as the resultant force which acts vertically upwardly through the center of buoyancy which is located at the geometric center of the sailboat's underwater body. From Archimedes' law, we know that an object floating on a fluid is buoyed up by a force equal to the weight of the fluid it displaces.

When the sailboat is at rest in the water, the center of gravity and the center of buoyancy lie in the same vertical line.

The moment of a force is the tendency of the force to produce a rotation or to move an object about an axis. The distance between the point at which the force is acting and the axis of rotation is called the moment arm. When the lateral force of wind against the sail plane of a sailboat creates an inclining moment on a sailboat, the sailboat is caused to heel over to some angle. This causes a change in the shape of the sailboat's underwater body and a consequent relocation in the center of buoyancy. Because of the shift in location of the center of buoyancy, the center of buoyancy and the center of gravity no longer act in the same vertical line. Instead, they form a couple. The combination of the center of gravity and the center of buoyancy produce a righting moment. When sailing, with the hull heeled, the righting moment of the hull equals the inclining moment against the mast. However, if the force of the wind against the sail and mast exceeds the righting moment of the hull, the sailboat capsizes.

The present invention is based upon the realization that the righting moment of the hull should be taken advantage of to the greatest degree possible, and that this can be accomplished by providing a mast which is pivotably mounted at or near the deck level of the sailboat, with control cables extending through port and starboard winches to the top of the mast, such that the mast can be controllably inclined to port or starboard as desired to improve the relationship of mast to hull.

The means for pivotably mounting the mast are in no way limited, so long as the mast can be caused to pivot to port and to starboard. For example, it is well known to provide "collapsible" or "folding" masts on sailboats in order to enable them to pass under bridges with low clearances. Any such mounting system which permits pivoting in two directions can be used in the present invention. Obviously, however, the masts which are designed to be collapsible for-and-aft must be mounted so as to be pivotable port-to-starboard.

As a further example of a mounting system, one wing of a conventional large door hinge may be bolted to the deck, and the mast may be bolted to the free wing of the hinge so as to be pivotable port-to-starboard. Alternatively, two uprights protruding about six inches above the deck may be provided, one fore and one aft of the mast, with a space therebetween corresponding to the cross-sectional diameter of the mast at the attachment point, such that the mast can be inserted between the two mast posts and pivotably mounted on a load bearing member having a fore-and-aft axis.

Alternatively, the mast may be provided with a bore hole or bushing extending fore-and-aft. The mounting hardware provided on the deck for receiving the mast is provided with a shaft or axle, such as an unthreaded bolt, for connecting the mast to the mounting hardware. A bushing may be provided between the shaft and the mast bore hole. The bushing is preferably a frictionless roller which may be slippery silicon-plastic, or may have bearings such as metal ball bearing means, or any conventional bearing or journaling means which permit the mast to rotate freely about the axis of the axle.

The bore hole may be provided through the mast itself, as discussed above, but preferably the mounting hardware includes means for mounting to the deck, a socket for receiving the mast, and a flexible joint between the socket and mount, such that a mast need not be modified in order to be fitted to the system and device of the present invention. That is, the conventional deck mounting hardware for receiving the mast of a sailboat may simply be dismounted and replaced with the mounting hardware of the present invention.

For wooden masts, "bracelets" surrounding the mast and having forward and aft protrusions may be used.

For masts originally designed to fit through the hull, these masts may be modified by cutting the mast at deck level, bolting the mounting system to the deck, and inserting the appropriately modified mast into the mounting hardware.

Obviously, it is not possible to describe herein all variations of pivot means.

The mast which is so pivotable about an axis at or near deck level may be controllably pivoted by means such as manual power, hydraulic power, pneumatic power, etc. but is preferably controlled by electrical power using electric winches via cables. One or more cables run from the port side of the sailboat to the top of the mast and are controlled by a winch, e.g., a port winch. One or more cables run from the starboard side of the sailboat to the top of the mast and are controlled by a winch, e.g., a starboard winch. Obviously, a single winch can be used to control both cables.

The design of the system and device of the present invention will now be described with reference to the figures.

FIG. 1 is a simplified diagram showing a sailboat with hull 1 including keel 2, ballast 3 and deck 4 designed in a conventional manner. Port 5 and starboard 6 winches are provided with port 7 and starboard 8 cables. Cables 7, 8 are connected to the top of mast 9. The foot of mast 9 is pivotably mounted to the deck using mounting hardware 10. Electrical supply such as battery 11 is connected to the port and starboard winches 5, 6 via control means 12 for selectively controlling winches.

In operation, wind will impacts on the sail with a forward component and a transverse component. The transverse component will cause mast 9 and thus the sailboat to tilt to leeward. For example, as the wind enters the sail from port, the mast will be urged to starboard. So long as the port and starboard winches are not operated, the sailboat can be sailed in a conventional manner.

As the sailor decides that the sailboat is heeled too far for comfort or for safety, the sailor simply activates one or both winches to draw the mast to leeward. The result will be that the mast will appear to the person on the sailboat to move to leeward, but in fact, the sail will remain substantially in the same orientation and while the hull pivots toward vertical. The hull is thus rotated until the sailor has decided that the sailboat is comfortable and safe.

Figure 2:
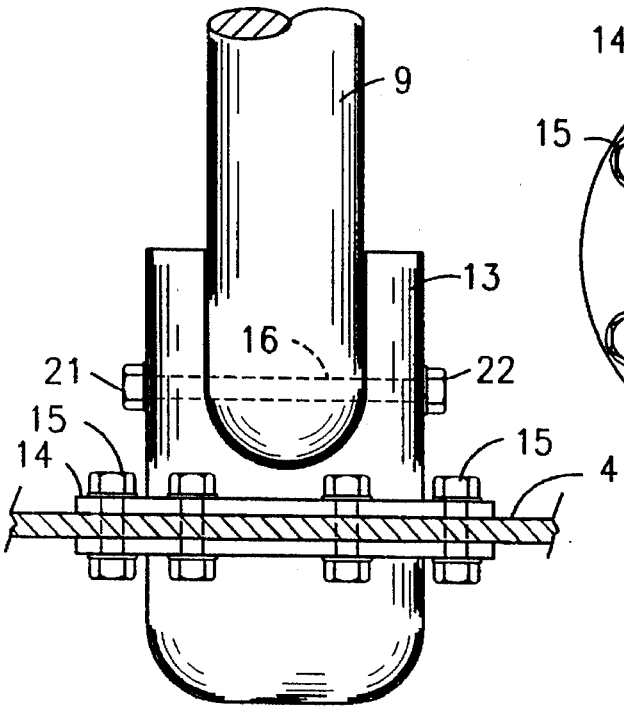
FIG. 2 shows one example of hardware for mounting a pivotable mast in fore-and-aft cross-section.
Figure 3:
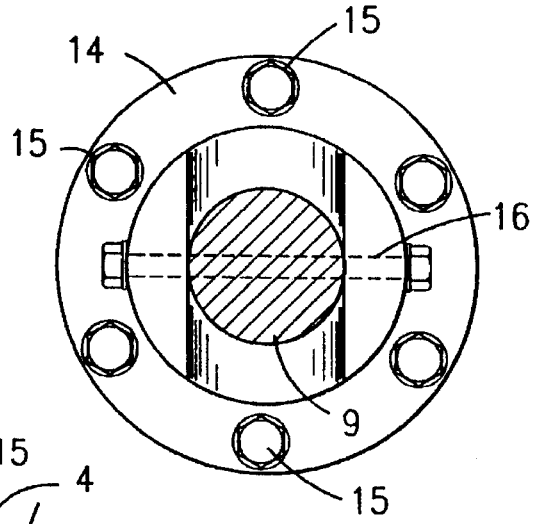
FIG. 3 shows the mast mounting hardware of FIG. 2 from above.
Figure 4:
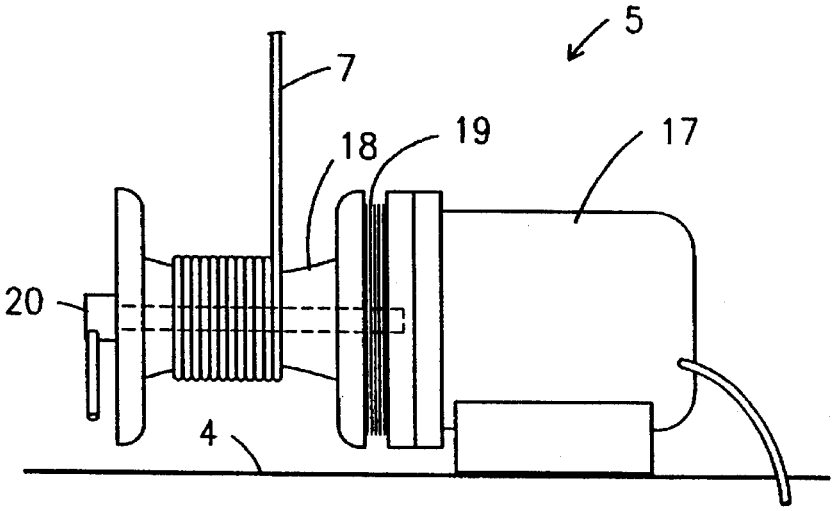
FIG. 4 shows an electric winch with clutch for use in the invention.

FIG. 2 shows a more detailed view of one example of mounting hardware. Receptacle 13 having a lower flange 14 for mounting flush to deck 4 is securely mounted to the deck by attachment means such as metal fasteners 15. Mast 9 is provided with a fore-and-aft running bore-hole 16 along the axis of rotation. Non-threaded bolt 21 and nut 22 secure the mast pivotably to receptacle 13. Receptacle 13 is provided with forward and aft uprights which prevent fore-and-aft movement of the mast, and has port and starboard recesses which permit port-to-starboard pivoting of the mast.

Winch 6 preferably comprises an electric motor 17 connected to capstan or windlass 18 via clutch 19. The clutch may be any type of clutch, such as dry plate clutch, ratchet and pawl clutch, wet clutch, etc., and is preferably adjustable by adjusting means 20. The adjustment to the winch clutch makes possible the setting of the point of slippage. In this way, the sailor can be assured that a sudden gust of wind will not result in capsizing of the sailboat. Rather, the sudden gust of wind will cause the mast to suddenly increase tension on the windward Clutch, and if the tension is greater than the slippage setting of the clutch, the clutch will slip and release the cable until the tension is again lowered below the slippage setting. In this way, the mast will pivot only so far to leeward as necessary to prevent capsizing.

The winches are preferably controlled by means of tension sensors which provide feedback to control 12. For example, if a gust of wind causes mast 9 to move to starboard causing cable 7 to be tensioned beyond the slippage setting of clutch 5 so that cable 7 is unwound from winch 5, two things will happen. On the starboard side, winch 6 senses that the tension in cable 8 is below a preset value, and will energize to take up slack. On the port side, slippage will occur until the tension of cable 7 is less than the preset slippage value, at which point clutch 19 will engage and not permit any further play out of cable.

The mast can be reset either manually or electronically. For manual setting, the control unit can actuate one or both winches so as to cause return of the mast to the position perpendicular to the deck. Electronically, the control unit may be provided with a horizon sensor, so as to detect the orientation of the deck and the orientation of the mast with respect to the deck. The control unit can be programmed so that either after a predetermined amount of time, or after the tension on the windward cable drops below a preset value, the windward cable is caused to energize, returning the mast all the way or part of the way towards perpendicular.

In this way, by sensing cable tensions, the true orientation of the deck, and the relative orientation of the mast to the deck, it becomes possible to automatically control the mast so that sailing becomes safe, comfortable, and worry free. Capsizing is prevented, and the optimum amount of sail consistent with a generally horizontal sailboat is constantly provided.

Of course, the control unit may be turned off at any time so that the sailboat can be sailed in the same manner as a conventional sailboat.

The present invention is in no way limited by the above theory. The theory merely represents the inventors best understanding of the invention at the time of filing the application.

Obviously, the single port control cable and single starboard control cable discussed with respect to the illustrative embodiment may be replaced by two or more cables. Preferably three or four cables are provided on each side for increased stability.

Although the system was first designed for use with single masted sailboats, it will be readily apparent that the system and device is capable of other uses, such as multi-masted sailboats, sail assisted power boats, wind generators, etc. Although this invention has been described in its preferred form with a certain degree of particularity with respect to a single masted sailboat, it is understood that the present disclosure of the preferred form has been made only by way of example and that numerous changes in the details of structures and the composition of the system may be resorted to without departing from the spirit and scope of the invention.

Now that the invention has been described,

What is claimed is:

1. A sailboat comprising:

a hull having a deck having a port side, a starboard side, and a central portion between said port and starboard sides;

at least one mast extending above said deck, said mast being pivotably attached to said hull about a fore-and-aft running axis so as to be pivotable to port and to starboard; and a means for controllably pivoting said mast in the port-to-starboard direction;

wherein said means for controllably pivoting the mast to port or starboard comprises at least one starboard cable, at least one port cable, at least one starboard winch for controlling said starboard cable, and at least one port winch for controlling said port cable;

wherein said port and starboard cables are attached to said mast at a point near the top of said mast: and wherein said port cables are controlled by means of at least one port winch, and said starboard cables are controlled by at least one starboard winch, wherein said winches are provided with adjustable slippage clutches, and wherein said winches are controlled electronically by means of a control unit, wherein said control unit is provided with input regarding the tension on the port and starboard cables, such that said port and starboard cables are maintained within a minimum and a maximum tension.

2. A sailboat comprising:

a hull having a deck having aport side, a starboard side, and a central portion between said port and starboard sides;

at least one mast extending above said deck, said mast being pivotably attached to said hull about a fore-and-aft running axis; and a means for controllably pivoting said mast in the port-to-starboard direction;

wherein said means for controllably pivoting the mast to port or starboard comprises at least one starboard cable, at least one port cable, at least one starboard winch for controlling said starboard cable, and at least one port winch for controlling said port cable; and wherein said port and starboard cables are attached to said mast at a point near the top of said mast:

wherein said winches are provided with adjustable slippage clutches, and wherein said winches are controlled electronically by means of a control unit, wherein said control unit is provided with input regarding the true horizon, input regarding the orientation of the mast relative to the deck, and input regarding the tension on the port and starboard cables, such that said port and starboard cables are maintained within a minimum and a maximum tension, and wherein said minimum and said maximum tensions are values which are preset into said controller, such that:

when said mast is perpendicular to said deck and said deck is horizontal, tension on the windward winch is high;

when said mast is perpendicular to said deck and said deck is off-horizontal, the tension on the windward winch is lowered, and the tension on the leeward winch is increased until the deck reaches a preset horizontal value; and when said mast is pivoted to leeward and said deck is horizontal, tension on the windward winch is increased and tension on the leeward winch is decreased to cause the mast to be pivoted to a position perpendicular to the deck.

* * * * *